US006678975B1

(12) United States Patent
Renosky

(10) Patent No.: US 6,678,975 B1
(45) Date of Patent: Jan. 20, 2004

(54) DECORATIVE APPARATUS

(76) Inventor: Joseph Francis Renosky, 2120 Rte. 422 West, Indiana, PA (US) 15701

( * ) Notice: Subject to any disclaimer, the term of this patent is extended or adjusted under 35 U.S.C. 154(b) by 0 days.

(21) Appl. No.: 10/395,534

(22) Filed: Mar. 24, 2003

Related U.S. Application Data

(60) Provisional application No. 60/389,570, filed on Jun. 18, 2002.

(51) Int. Cl.[7] ..... G09F 19/00

(52) U.S. Cl. ..... 40/124.5; 47/41.01; 47/41.12; 47/41.13

(58) Field of Search ..... 40/124.5; 47/41.01, 47/41.12, 41.13, 41.14

(56) References Cited

U.S. PATENT DOCUMENTS 585,486 A * 6/1897 Snow ..... 47/41.01
4,640,045 A * 2/1987 Nesbitt et al. ..... 47/41.01
5,072,542 A * 12/1991 Quackenbush ..... 47/41.01
5,177,899 A * 1/1993 Powell ..... 47/65.5
5,279,072 A * 1/1994 Garbo ..... 47/41.14
5,368,266 A * 11/1994 Allen ..... 47/39
6,108,971 A * 8/2000 Zaremba ..... 47/65.5
6,128,855 A * 10/2000 Salamh et al. ..... 47/41.01
6,145,245 A * 11/2000 Honkawa et al. ..... 47/41.01
D435,230 S * 12/2000 Spiegel ..... D11/143

* cited by examiner

*Primary Examiner*—Gary Hoge
(74) *Attorney, Agent, or Firm*—George H. Morgan

(57) ABSTRACT

A decorative apparatus comprising a frog, a frog holder, a decorative attachment, and a means of attaching, positioning and orienting the decorative attachment.

6 Claims, 6 Drawing Sheets

DECORATIVE APPARATUS

CROSS REFERENCES TO RELATED APPLICATIONS

Provisional application for Pat. No. 60/389,570 of Jun. 18, 2002, with the same title, "Decorative Apparatus", which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a decorative apparatus suitable for, but not restricted to, use as a graveyard memorial.

2. Background Information

Applicant came up with his invention because he couldn't find what he wanted in a suitable decorative apparatus.

As will be seen from the subsequent description, the preferred embodiments of the present invention overcomes limitations of existing decorative apparatuses.

SUMMARY OF THE INVENTION

The preferred embodiment of the present invention, a decorative apparatus, comprises a frog, a frog holder, and a decorative attachment.

The frog holder, in the preferred embodiment of the present invention, comprises a container, at least one mount, and a means of attaching, positioning, and orienting the decorative attachment.

The decorative attachment, in the preferred embodiment of the present invention, glows in the dark. This can be accomplished by use of an appropriate material that is known in the art either as an ingredient in a decorative plastic attachment or in a coating applied to the decorative attachment.

DESCRIPTION OF THE PREFERRED EMBODIMENTS

Figure 1:
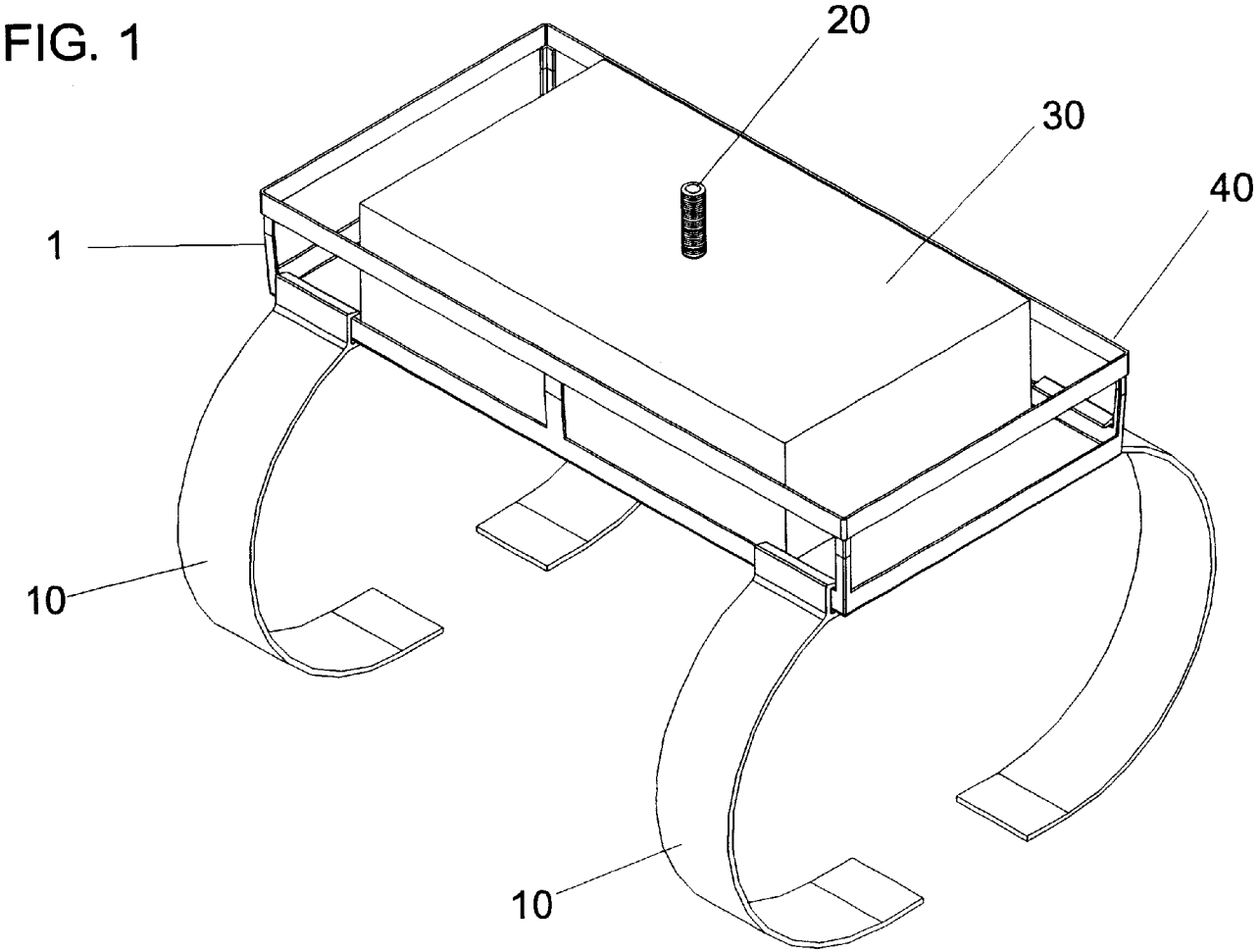
FIGS. 1, 2, and 6 illustrate the preferred embodiment of the present invention, a decorative apparatus 1.
Figure 2:
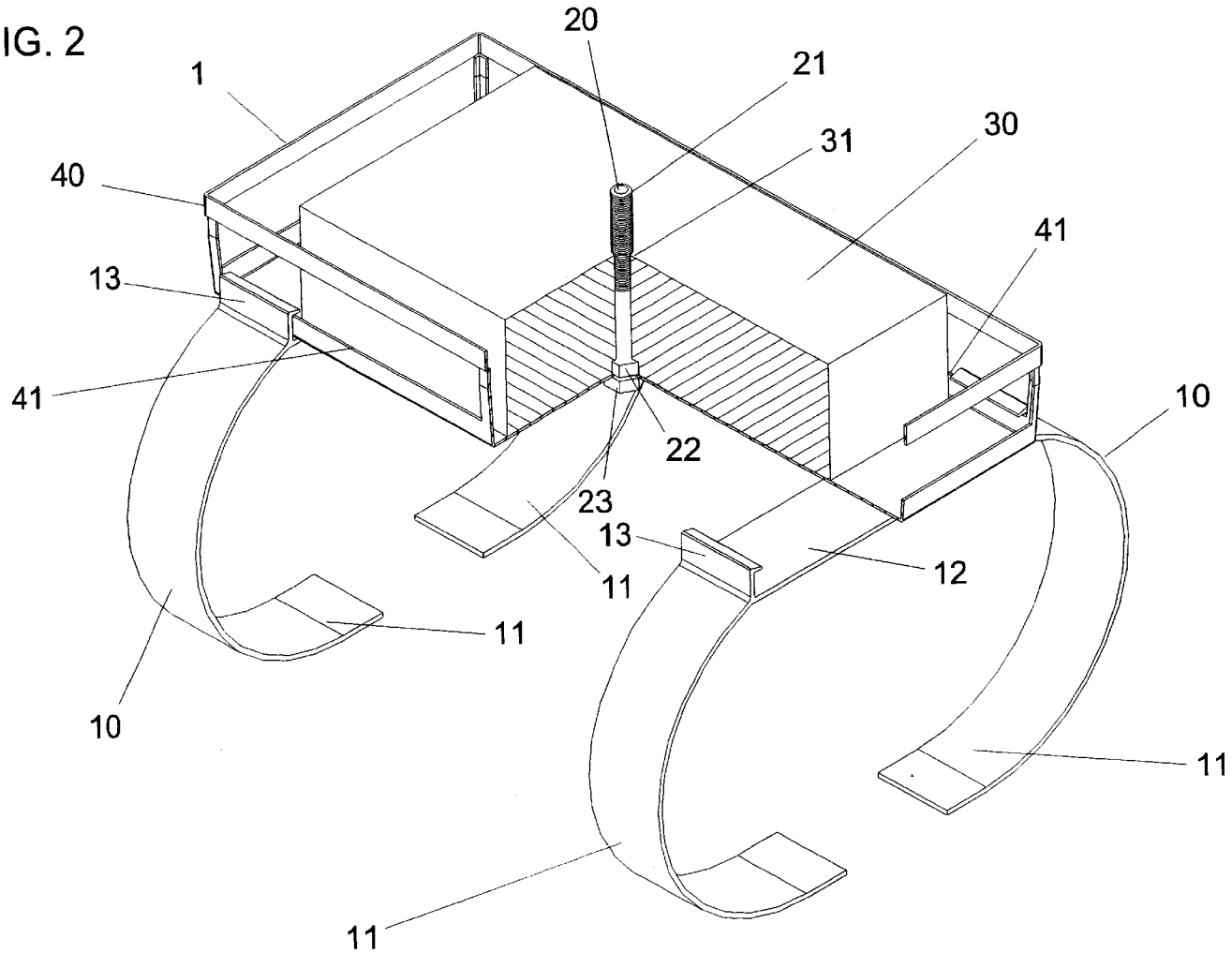
Figure 6:
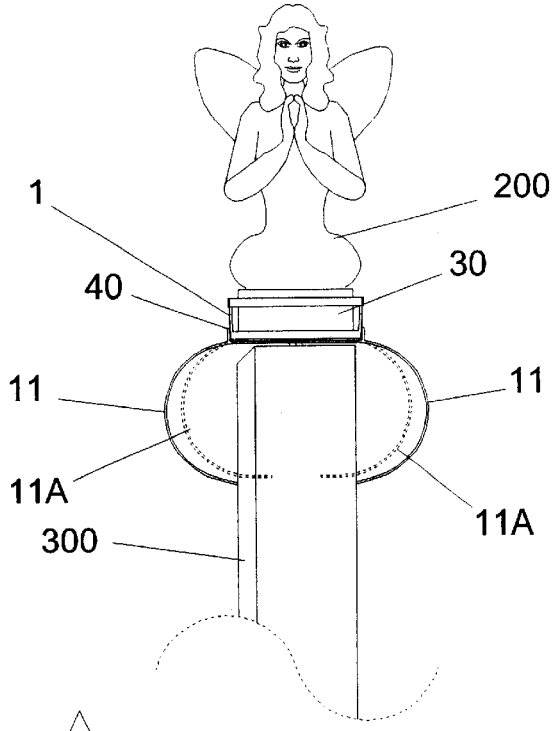

Referring to FIGS. 1, 2, and 6, the preferred embodiment of the present invention, a decorative apparatus 1, comprises a frog 30, a frog holder 40, a threaded rod assembly 20, and a decorative attachment 200.

The frog 30 comprises a threaded rod clearance 31.

The frog holder 40 comprises a container 41 and mounts 10.

Each mount 10 comprises a container support 12, at least one clamp 11, and an attachment means 13.

The threaded rod assembly 20 further comprises a threaded rod 21, and locking nuts 22 and 23.

The threaded rod 21, of the threaded rod assembly 20, is attached to the container 40 by means of the locking nuts 22 and 23. The frog 30 rests in the container 41, with the threaded rod 21 passed through the threaded rod clearance 31 of the frog 30. The decorative attachment 200 threads onto the threaded rod 21 of the threaded rod assembly 20.

The threaded rod assembly 20 serves as a means of attachment, positioning, and orientation of the decorative attachment 200 to the frog holder 40.

The decorative attachment 200, in the preferred embodiment of the present invention, glows in the dark. This can be accomplished by use of appropriate materials, known in the art, either as one or more ingredients in a plastic material used to manufacture the decorative attachment 200 or in a coating applied to the decorative attachment 200.

The decorative apparatus 1 is held in place on a marker 300, with clamps 11. Dotted lines 11A indicate undistorted positions of the clamps 11.

The function of the frog 30 is to permit insertion of flowers or other appropriate inserts. Thus it would be possible to surround a phosphorescent decorative attachment 200 with real or artificial flowers or with other decorations (not shown). These flowers and decorations would serve both to hide the frog 30 and to augment the appearance of the device.

The preferred material of construction of the frog 30 is a rigid foam plastic. However, as obvious to anyone skilled in the art, frogs have been constructed in many forms and of many materials.

Figure 3:
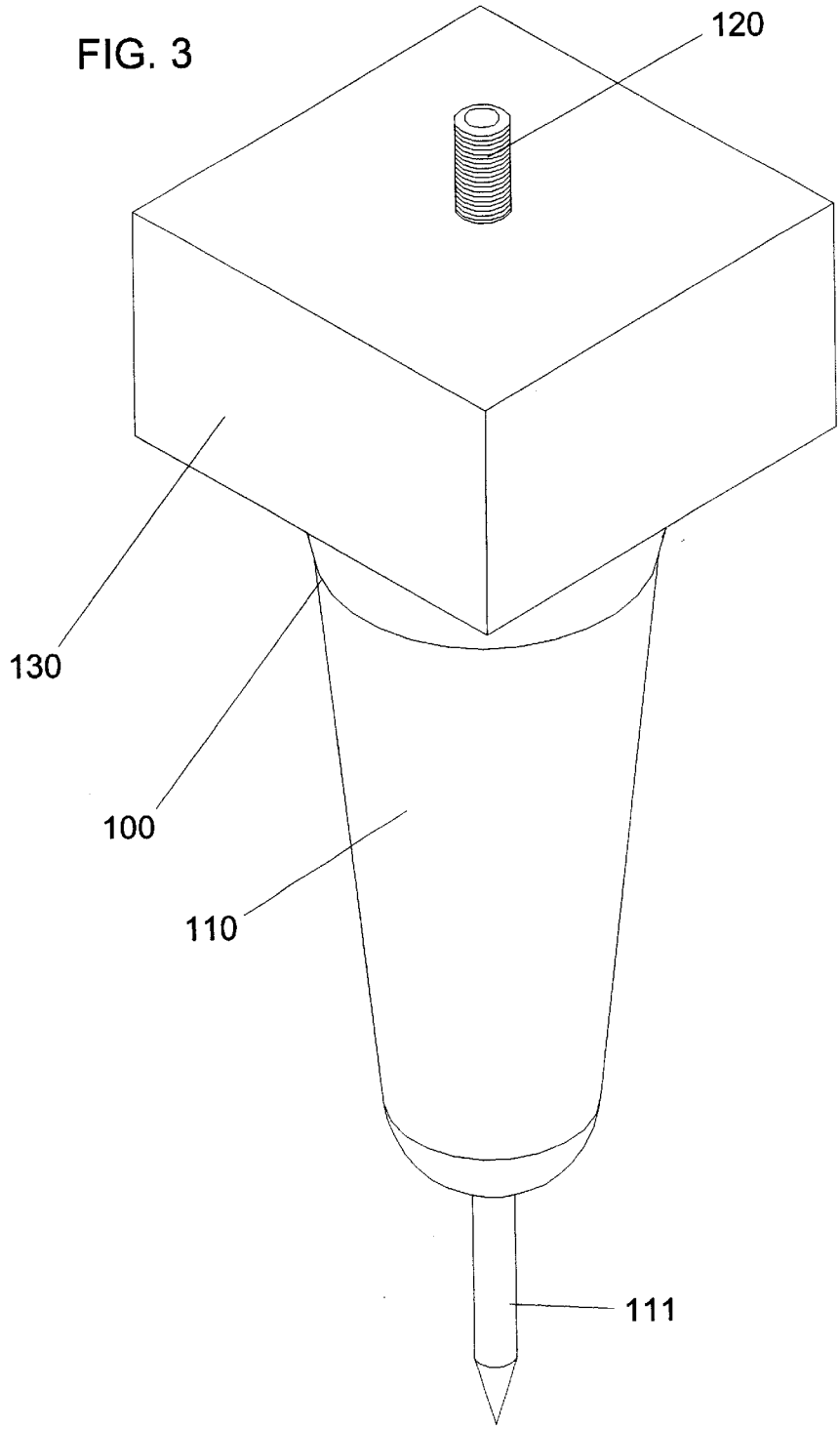
FIGS. 3, 4, and 7 illustrate an alternate embodiment of the present invention, an alternate decorative apparatus 100.
Figure 4:
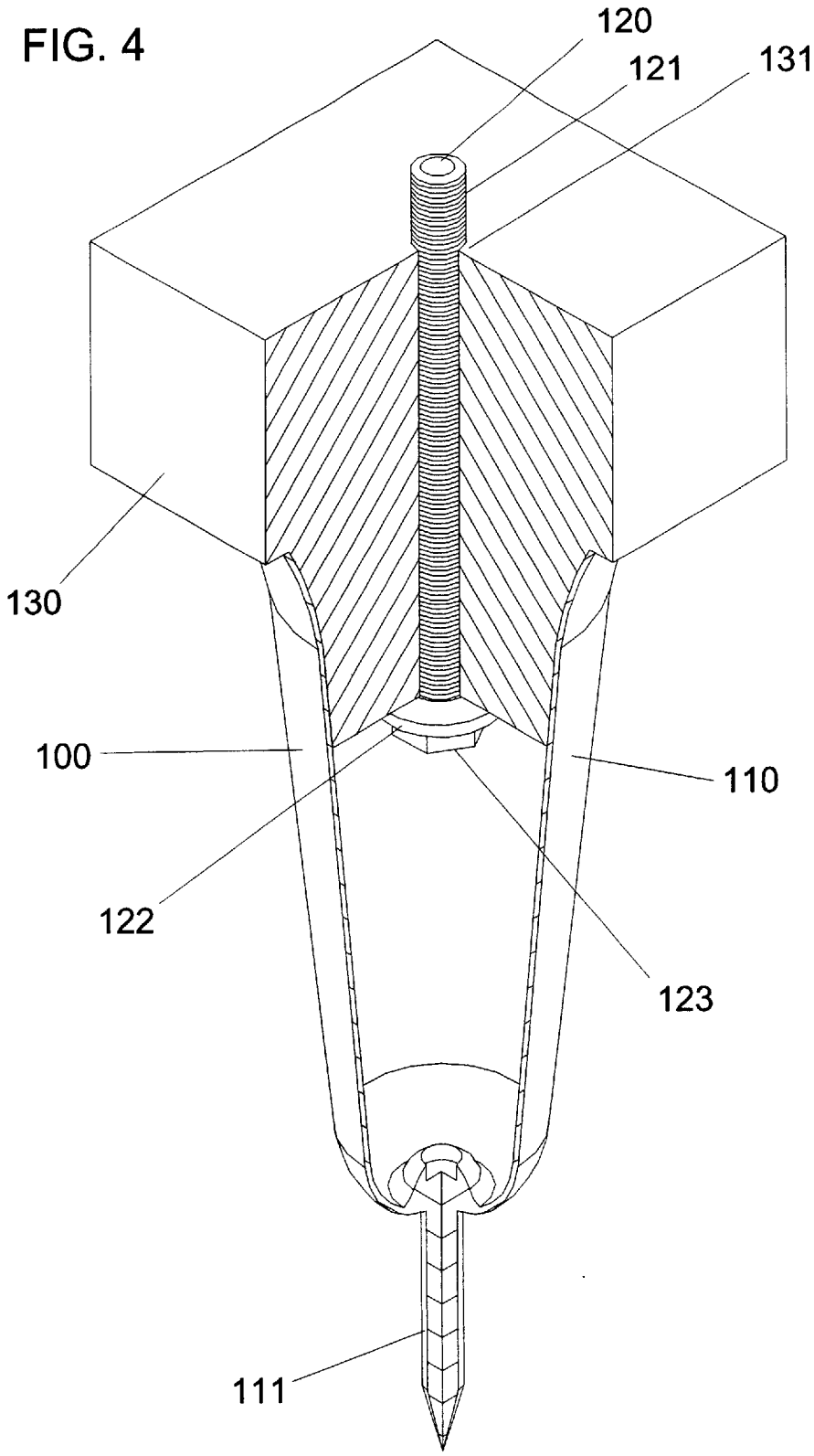
Figure 7:
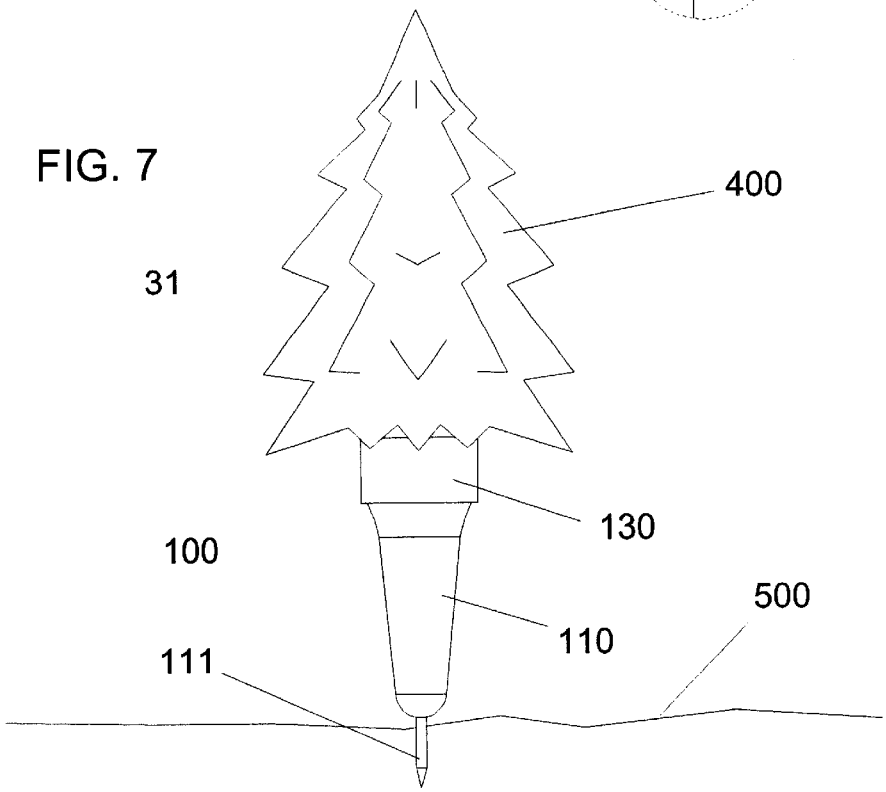

Referring to FIGS. 3, 4, and 7, an alternate embodiment of the present invention, an alternate decorative apparatus 100 comprises an alternate frog 130, an alternate frog holder 110, an alternate threaded rod assembly 120, and an alternate decorative attachment 400.

The alternate frog holder 110 comprises an alternate mount 111. In the preferred embodiment of the present invention, the alternate mount 111 is a spike.

The alternate threaded rod assembly 120 comprises an alternate threaded rod 121, a washer 122, and a retaining nut 123.

The alternate threaded rod assembly 120 inserted through an alternate clearance 131 of the alternate frog 130 is a member that serves as a means of attachment, positioning, and orientation of the alternate decorative attachment 400.

The alternate frog 130 seats into the alternate frog holder 110 as indicated in FIG. 4.

As indicated in FIG. 7, the alternate decorative apparatus 100 is supported by the alternate mount 111 inserted into, a ground 500.

Figure 5:
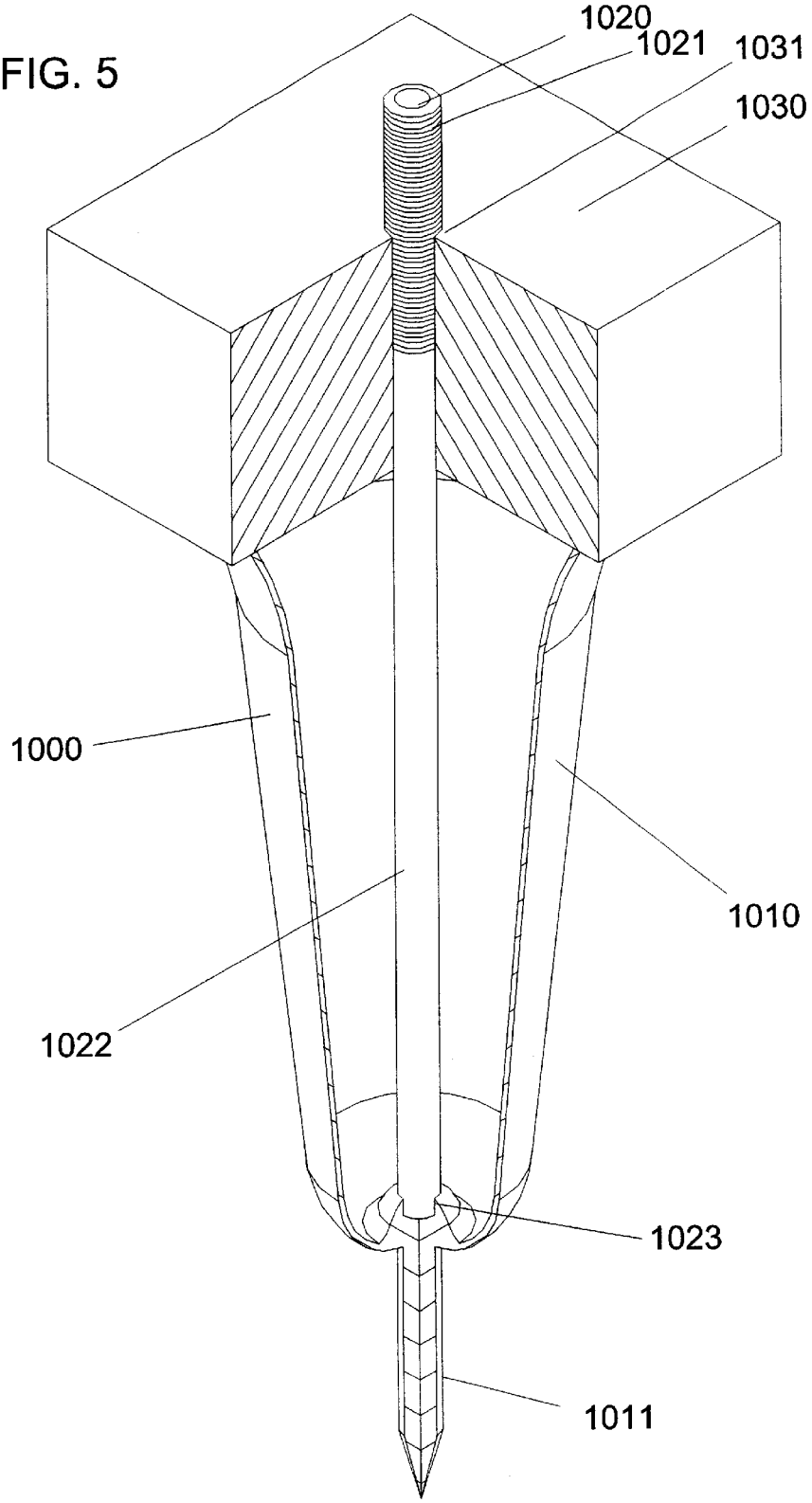
FIG. 5 illustrates another alternate embodiment of the present invention, a second alternate decorative apparatus 1000.

Referring to FIG. 5, a second alternate embodiment of the invention, a second alternate decorative apparatus 1000 comprises a second alternate frog 1030, a second alternate frog holder 1010, and a second alternate threaded rod 1020.

The second alternated threaded rod 1020 comprises an upper threaded end 1021, a shank 1022, and a lower threaded end 1023.

The second alternate frog 1030 is held in position against the second alternate frog holder 1010 by means of the second alternate threaded rod 1020. The upper threaded end 1021 is a larger diameter than a corresponding clearance 1031 in said frog 1030 and the lower threaded end 1023 threads into said frog holder 1010.

Frog holder 1010 comprises a second alternate mount 1011.

Although the description above contains many specificities, these should not be construed as limiting the scope of the invention but as merely providing illustrations of some of the presently preferred embodiments of this invention.

For example, said decorative attachments 200 and 400 were shown respectively as an angel and a tree. Many other decorative attachments would serve the same purpose, such as, but not restricted to, seasonal decorations such as a snow man or a flag; a figure such as, but not restricted to a fireman, a policeman, a soldier, or nurse; or symbols such as fraternity or sorority emblems.

The marker 300 is often, but is not restricted to, a gravestone. Markers are used for marking other sites than graves.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A decorative apparatus for use in combination with a grave stone comprising:

a) a foam frog, b) a frog holder, c) at least one mount for attaching the apparatus to the grave stone, d) a decorative attachment, and e) a threaded member passing through said frog for attachment to said decorative attachment.

2. The decorative apparatus of claim 1 wherein said foam frog is a block of rigid foam.

3. The decorative apparatus of claim 1 wherein said at least one mount includes a pair of flexible clamps having an opening there between such that when said apparatus is in use on a gravestone said flexible clamps retain said apparatus in place on said stone.

4. The decorative apparatus of claim 3 wherein the holder and the clamps are of molded plastic and wherein the clamps include means attaching said clamps to said holder.

5. The decorative apparatus of claim 3 wherein the decorative attachment is phosphorescent.

6. A decorative apparatus for outdoor use comprising:

a) a foam frog;

b) a frog holder;

c) at least one mount for supporting the apparatus;

d) a decorative attachment; and e) a member passing through said foam frog for attachment to said decorative attachment such that items may be inserted into the foam frog adjacent to said decorative attachment;

wherein the at least one mount includes a spike to support the decorative apparatus in the ground;

wherein the at least one mount includes a pair of flexible clamp members having a first position with a gap there between and a second position with a wider gap there between; and wherein the decorative attachment is phosphorescent; and wherein said member passing through said foam frog includes threads on an end thereof for attachment to said decorative attachment.

* * * * *